US010968922B2

(12) United States Patent
Thaser et al.

(10) Patent No.: US 10,968,922 B2
(45) Date of Patent: Apr. 6, 2021

(54) RADIAL COMPRESSOR

(71) Applicant: MAN ENERGY SOLUTIONS SE, Augsburg (DE)

(72) Inventors: Boris Thaser, Augsburg (DE); Matthias Strauss, Schrobenhausen (DE); Oswald Löwlein, Neu-Ulm (DE); Sven Eisenbach, Augsburg (DE)

(73) Assignee: MAN Energy Solutions SE, Augsburg (DE)

( * ) Notice: Subject to any disclaimer, the term of this patent is extended or adjusted under 35 U.S.C. 154(b) by 78 days.

(21) Appl. No.: 16/269,216

(22) Filed: Feb. 6, 2019

(65) Prior Publication Data

US 2019/0242402 A1 Aug. 8, 2019

(30) Foreign Application Priority Data

Feb. 7, 2018 (DE) ..... 102018102704.4

(51) Int. Cl.
*F04D 29/68* (2006.01)
*F04D 29/42* (2006.01)
*F04D 29/62* (2006.01)

(52) U.S. Cl.
CPC ..... *F04D 29/685* (2013.01); *F04D 29/4206* (2013.01); *F04D 29/624* (2013.01); *F05D 2220/40* (2013.01)

(58) Field of Classification Search
CPC ..... F04D 29/42; F04D 29/685
See application file for complete search history.

(56) References Cited

U.S. PATENT DOCUMENTS 3,143,103 A * 8/1964 Zuhn ..... F02B 37/005 60/599
4,479,755 A * 10/1984 Skoe ..... F04D 27/023 415/1

(Continued)

FOREIGN PATENT DOCUMENTS

EP 2 194 277 6/2010

OTHER PUBLICATIONS

Ruitao Qu, Peng Zhang, Zhefeng Zhang, "Notch Effect of Materials: Strengthening or Weakening?", May 6, 2014, Shenyang National Laboratory for Materials Science, Institute of Metal Research, Chinese Academy of Sciences, Shenyang 110016, China, p. 600-609 (Year: 2014).*

(Continued)

*Primary Examiner* — Ninh H. Nguyen
*Assistant Examiner* — Brian Christopher Delrue
(74) *Attorney, Agent, or Firm* — Cozen O'Connor

(57) ABSTRACT

A radial compressor having an impeller having a housing with a radially outer and a radially inner insertion section a main flow channel for suppling a medium towards the impeller, a circulation chamber radially outside of the main flow channel separated from the main flow channel by a contour wall and connected to the insertion section via struts. The main flow channel is delimited by the contour wall and by a first segment of the insertion section. The struts engage with a second segment of the insertion section. The second segment of the insertion section engages with a downstream end of the first segment of the insertion section. The upstream end of the first segment of the insertion section protrudes freely in the direction of the contour wall. The first segment of the insertion section has a constant thickness.

11 Claims, 1 Drawing Sheet

(56) References Cited

U.S. PATENT DOCUMENTS 4,743,161 A * 5/1988 Fisher ..... F04D 29/4213 415/116
4,930,978 A * 6/1990 Khanna ..... F04D 29/4213 415/58.3
4,981,018 A * 1/1991 Jones ..... F02C 3/08 415/143
5,186,601 A * 2/1993 Treece ..... F04D 27/0238 415/173.1
5,246,335 A * 9/1993 Mitsubori ..... F04D 29/4213 415/214.1
5,295,785 A * 3/1994 Church ..... F04D 29/4213 415/119
5,399,064 A * 3/1995 Church ..... F04D 29/4213 415/119
6,623,239 B2 * 9/2003 Sahay ..... F02B 37/16 415/11
7,475,539 B2 * 1/2009 Chen ..... F04D 29/4213 415/144
7,775,759 B2 * 8/2010 Sirakov ..... F04D 29/4213 415/1
8,210,794 B2 * 7/2012 Nolcheff ..... F04D 17/025 415/228
8,272,832 B2 * 9/2012 Yin ..... F04D 29/444 415/58.4
8,690,524 B2 * 4/2014 Yin ..... F04D 29/685 415/119
9,163,516 B2 * 10/2015 Oliphant ..... F01D 5/141
9,163,525 B2 * 10/2015 Alexander ..... F01D 25/00
9,377,030 B2 * 6/2016 Matwey ..... F04D 29/444
9,719,518 B2 * 8/2017 Mohtar ..... F01D 17/141
9,726,185 B2 * 8/2017 Chen ..... F04D 17/10
10,436,211 B2 * 10/2019 McArdle ..... F04D 27/009
10,519,974 B2 * 12/2019 Alcaraz ..... F04D 29/663
10,605,118 B2 * 3/2020 Hoβbach ..... F02C 6/12
2009/0060727 A1 * 3/2009 Moss ..... F04D 29/624 415/196
2010/0143111 A1 * 6/2010 Kuehnel ..... F04D 29/685 415/208.1
2018/0073515 A1 * 3/2018 Kanzaka ..... F04D 29/685

OTHER PUBLICATIONS

Joseph F. Murphy, "Strength and Stiffness Reduction of Large Notched Beams", Journal of Structural Engineering, vol. 112, No. 9, Sep. 1986. p. 1989-2000 (Year: 1986).*

* cited by examiner

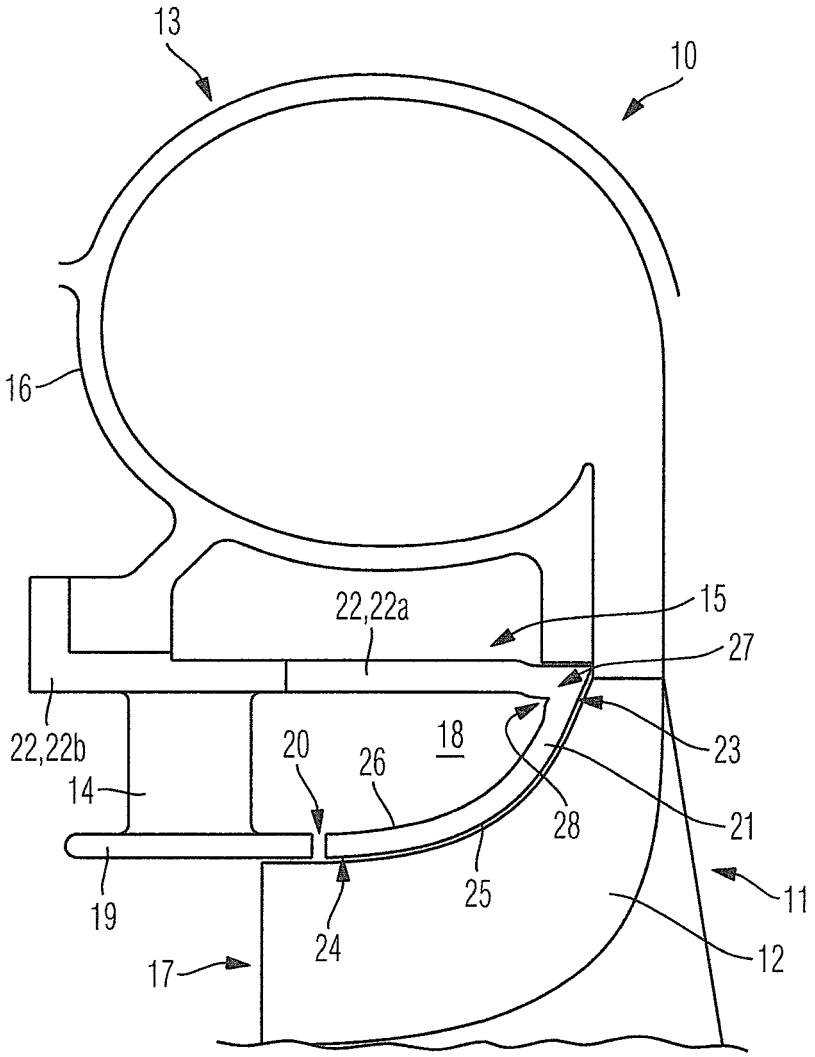
13
10
16
22,22a
15
27
22,22b
20
26
18
23
14
28
21
19
25
11
24
12
17

RADIAL COMPRESSOR

BACKGROUND OF THE INVENTION

1. Field of the Invention

The invention relates to a radial compressor.

2. Description of the Related Art

A radial compressor of an exhaust turbocharger is known from EP2,194,277 A1. For instance, EP 2 194 277 A1 shows a radial compressor comprising an impeller on the rotor side and a housing on the stator side. The housing defines a main flow channel to guide a medium, which is to be compressed, in the direction of the impeller. A circulation chamber, which is separated from the main flow channel by a contour wall, is arranged outside of the main flow channel. According to EP 2 194 277 A1, the circulation chamber extends all the way to a circulation opening in the area of the impeller. In the area of the impeller, the circulation chamber is connected to the main flow channel via the circulation opening. Struts, via which the contour wall, which separates the main flow channel from the circulation chamber, is connected to the housing, run inside the circulation chamber.

According to EP 2 194 277 A1, the housing of the radial compressor has a radially outer spiral housing section and a radially inner insertion section. The spiral housing section and insertion section are thereby made in once piece. A first segment of the insertion section defines the main flow channel downstream from the contour wall. The contour wall is connected via the struts to a second segment of the insertion section. The second segment of the insertion section, with the which struts engage, engages in turn with an upstream end of the first segment of the insertion section.

In the event of damage to such a radial compressor, fragments of the impeller can hit the insertion section. To date, the insertion section of such a radial compressor cannot deform in a defined manner in the event of failure. Instead, the deformation of the insertion section is made impossible by the structural connection of the second segment of the insertion section to the first segment of the insertion section. As a result, the forces resulting from the impact of the fragments into the insertion section are transferred into the spiral housing section. The containment safety is thereby limited, because an overloading of the spiral housing section and/or of a flange connection between spiral housing section and bearing housing can result and fragments can reach into the surrounding area.

SUMMARY OF THE INVENTION

There is a need to increase the containment safety of a radial compressor.

Based on this, one aspect of the invention is based on creating a novel radial compressor.

According to one aspect of the invention, the second segment of the insertion section engages with a downstream end of the first segment of the insertion section. The upstream end of the first segment of the insertion section protrudes in the direction of the contour wall in a freely floating manner. Viewed in the meridian section, the first segment of the insertion section has an approximately constant thickness with a thickness deviation of maximally 5% across its extension between the downstream end and the upstream end.

It is possible according to one aspect of the invention that the first segment of the insertion section can deform into the circulation chamber in a defined manner, namely in particular when fragments of the impeller of the radial compressor hit the insertion section in the event of damage. The thickness of the first segment of the insertion section, which is approximately constant viewed in the meridian section, between the downstream end and the upstream end comprising a thickness deviation of maximally 5%, in combination with the other above-mentioned features, ensures the defined deformation of the insertion section.

In the event of failure of the radial compressor, a defined deformation of the insertion section, namely of the first segment of the insertion section, which delimits the main flow channel at least in sections, is thereby made possible. An introduction of force into the spiral housing section and/or into the flange connection between spiral housing section and bearing housing is prevented or highly reduced, respectively.

According to an advantageous further development, the first segment of the insertion section is surface-treated on a first side, which faces the main flow channel, and on a second side, which faces away from the main flow channel. The surface treatment of the first segment of the insertion section on both sides thereof supports the defined deformation thereof in the event of damage and thus further increases the containment safety.

According to an advantageous further development, the first segment of the insertion section has an approximately constant thickness with a thickness deviation of maximally 2%, preferably of maximally 1%, across its extension. Such a defined thickness of the first segment of the insertion section supports the defined deformation thereof and further increases the containment safety of the radial compressor.

According to an advantageous further development, a material recess in particular in the form of a notch is formed in a transition area between the first segment of the insertion section and the second segment of the insertion section on a side, which faces away from the main flow channel. The material recess supports the defined deformation of the first segment of the insertion section in the event of failure of the radial compressor, in particular when fragments of the impeller hit the first segment of the insertion section. The containment safety of the radial compressor can also be increased further thereby.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Preferred further developments of the invention result from the subclaims and from the following description. Exemplary embodiments of the invention will be described in more detail, without being limited thereto, by means of the drawing, in which The FIGURE is a schematized meridian section through a radial compressor according to the invention.

DETAILED DESCRIPTION OF THE PRESENTLY PREFERRED EMBODIMENTS

A radial compressor 10 has a rotor-side impeller 11 comprising a plurality of rotor blades 12. A radial compressor 10 further has a stator-side housing 13.

Of the stator-side housing 13, The FIGURE shows a radially inner insertion section 15, which is positioned in the area of the impeller 11, as well as a radially outer spiral housing section 16, which is arranged downstream from the impeller 11, which are embodied by separate assemblies in the exemplary embodiment of the FIGURE.

In the FIGURE, the housing 13 is of multi-part design and comprises the separate insertion section 15 as well as the separate spiral housing section 16, which are connected to one another.

In the shown preferred exemplary embodiment, the insertion section 15 and the radially outer spiral housing section 16 of the stator-side housing 13 are separated on the component side, so that they are provided by separate or individual components. In the shown preferred exemplary embodiment, the insertion section 15 thus does not delimit a spiral-like flow channel, which is defined by the spiral housing section 16, namely also not in sections.

It is important to point out that, in contrast to the shown exemplary embodiment, it is generally also possible that the insertion section 15 and the spiral housing section 16 can be formed in one piece and are provided by a monolithic assembly. It is generally also possible that the insertion section 15 delimits the spiral-like flow channel, which is defined by the spiral housing section 16, in sections.

The housing 13 of the radial compressor 10 defines a main flow channel 17 for medium, which is to be compressed, in order to guide the medium, which is to be compressed, in the direction of the impeller 11 via the main flow channel 17. Adjoining the main flow channel 17 radially on the outside, the housing 13 defines a circulation chamber 18. A contour wall 19, which is also defined as annular web, separates the main flow channel 17 from the circulation chamber 18 and separates the main flow channel 17 in sections.

The circulation chamber 18 extends from a section upstream of the impeller 11 into the area of the impeller 11. The FIGURE shows a circulation opening 20 in the area of the impeller 11, via which the circulation chamber 18 is connected to the main flow channel 17 in the area of the impeller 11. Struts 14 extend inside the circulation chamber 18.

The contour wall 19 is connected to the housing 13, namely to the insertion section 15 of the housing 13 in the shown exemplary embodiment via the struts 14.

The insertion section 15 of the housing 13 has a first segment 21, which delimits the main flow channel 17 downstream from the contour wall 19. The circulation opening 20 is formed between the contour wall 19 and this first segment 21 of the insertion section 15. The struts 14, with which the contour wall 19 engages as well, engage with a second segment 22 of the insertion section 15.

In the shown exemplary embodiment, the second segment 22 of the insertion section 15 is made in two pieces from the two parts 22*a* and 22*b*. The parts 22*a* and 22*b* can also be made in one piece or integrally, respectively.

The second segment 22 of the insertion section 15, with which the struts 14 engage, engages with a downstream end 23 of the first segment 21, which, adjoining the contour wall 19, delimits the main flow channel 17 in sections. The upstream end 24 of the first segment 21 of the insertion section 15 protrudes in the direction of the contour wall 19 in a freely floating manner. The circulation opening 20 is formed between the contour wall 19 and this upstream end 24 of the first segment 21 of the insertion section 15.

Viewed in the meridian section, the first segment 21 of the insertion section 15 has an approximately constant thickness or thickness profile, respectively, with a thickness deviation of maximally 5% across its extension between the downstream end 23 thereof and the upstream end 24 thereof.

In the event of damage, for example a fragment of the impeller 11 hit the insertion section 15, namely the first segment 21 thereof, the upstream end 24 of the first segment 21 of the insertion section 15 can deform into the circulation chamber 18 in a defined manner and can thus reduce kinetic energy of fragments of the impeller 11 in a defined manner. The forces introduced into the housing 13 in the event of damage can thus be controlled systematically in order to avoid an overloading of the spiral housing section 16 and a flange connection between spiral housing section and bearing housing and an escape of fragments into the surrounding area associated therewith. The containment safety is increased thereby.

To support or to improve, respectively, this defined deformation of the first segment 21 of the insertion section 15 in the event of damage to the compressor 10, the first segment 21 of the insertion section 15 is surface-treated on a first side 25, which faces the main flow channel 17, and on a second side 26, which faces away from the main flow channel 17, in particular in such a way that, viewed in the meridian section, the first segment 21 of the insertion section 15 has the approximately constant thickness or the approximately constant thickness profile, respectively, across its entire extension, thus starting at the upstream end 24 thereof in the direction of a transition area 27 to the second segment 22 of the insertion section 15. The approximately constant thickness allows for a thickness deviation of maximally 5 percent, preferably a thickness deviation of maximally 2 percent, particularly preferably a thickness deviation of maximally 1 percent.

When the thickness of the first segment 21 of the insertion section 15 is 10 mm, the thickness thus differs by maximally 0.1 mm from the thickness of 10 mm across the entire extension of the first segment 21 of the insertion section 15 between the upstream end 24 thereof and the transition area 27 to the second segment 22 or the downstream end 23 thereof, respectively, in the particularly preferred case.

The deformation behavior of the first segment 21 of the insertion section 15 can be further improved when a material recess, which is preferably designed as notch 28, is formed in the transition area 27 between the first segment 21 and the second segment 22 on the side 26 of the first segment 21, which faces away from the main flow channel 17.

As already specified, the insertion section 15 is of a multi-part design from the two parts 22*a*, 22*b*. The insertion section 15, however, can also be made integrally, whereby the two parts 22*a*, 22*b* are then in one piece.

In the event of damage, kinetic energy from the fragments of the impeller 11 can be reduced by means of the invention by means of a defined deformation of the first segment 21 of the insertion section 15. The spiral housing 16, in particular a spiral housing outer wall thereof, as well as a flange connection between spiral housing section and bearing housing, is then not subjected to any or to only a small stress and deformation. The containment safety is increased.

The radial compressor 10 of the FIGURE is a radial compressor of an exhaust turbocharger. Medium, which is to be compressed in the area of the impeller 11, flows axially against said radial compressor and the compressed medium flows radially away therefrom.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A radial compressor, comprising:

a rotor-side impeller;

a stator-side housing, comprising:

a radially outer spiral housing section; and a radially inner insertion section;

a main flow channel configured to supply a medium to be compressed towards the rotor-side impeller;

a contour wall;

a circulation chamber arranged radially outside of the main flow channel, which is separated from the main flow channel by the contour wall, and which is connected to the main flow channel via a circulation opening in an area of the rotor-side impeller;

struts that extend in the circulation chamber and connect the circulation chamber to the insertion section;

a first segment of the insertion section delimits the main flow channel downstream from the contour wall, the main flow channel is delimited by the contour wall upstream of the first segment, wherein the upstream end of the first segment is configured to deform into the circulation chamber upon failure of rotor-side impeller;

a second segment of the insertion section at which the struts engage;

a downstream end of the first segment of the insertion section engages with the second segment of the insertion section;

an upstream end of the first segment of the insertion section protrudes freely towards the contour wall;

wherein viewed in a meridian section, the first segment of the insertion section has an approximately constant thickness with a thickness deviation of maximally 5% across its extension between the downstream end and the upstream end.

2. The radial compressor according to claim 1, wherein the first segment of the insertion section on a first side, which faces the main flow channel, and on a second side, which faces away from the main flow channel is surface-treated to achieve the approximately constant thickness.

3. The radial compressor according to claim 1, wherein the first segment of the insertion section has an approximately constant thickness with a thickness deviation of at least one of maximally 2%, and maximally 1%, across its extension between the downstream end and the upstream end.

4. The radial compressor according to claim 1, wherein a material recess configured as a notch is formed in a transition area between the first segment of the insertion section and the second segment of the insertion section on a side, which faces away from the main flow channel.

5. The radial compressor according to claim 4, wherein the insertion section is formed integrally.

6. The radial compressor according to claim 4, wherein the insertion section is of multi-part design.

7. The radial compressor according to claim 4, wherein the insertion section and the radially outer spiral housing section of the stator-side housing are separated on a component side, and are provided by individual components.

8. The radial compressor according to claim 1, wherein the radial compressor is a radial compressor of an exhaust turbocharger.

9. The radial compressor according to claim 1, wherein the first segment has a thickness of 10 mm.

10. The radial compressor according to claim 1, wherein the first segment has a thickness of 10 mm.

11. The radial compressor according to claim 4, wherein the material recess is a V-shaped notch.

* * * * *